US005596970A

United States Patent [19]

Schoenberg et al.

[11] Patent Number: 5,596,970

[45] Date of Patent: Jan. 28, 1997

[54] FUEL PUMP FOR AN AUTOMOTIVE FUEL DELIVERY SYSTEM

[75] Inventors: Gregory B. Schoenberg, Ann Arbor; Jeong Y. Kim, Troy; Jeffrey J. Brautigan, Plymouth, all of Mich.

[73] Assignee: Ford Motor Company, Dearborn, Mich.

[21] Appl. No.: 623,091

[22] Filed: Mar. 28, 1996

[51] Int. Cl.[6] ..... F02M 37/04; F01D 1/12

[52] U.S. Cl. ..... 123/497; 415/55.1; 415/55.6

[58] Field of Search ..... 123/509, 497; 415/55.1, 55.5, 55.6, 55.7

[56] References Cited

U.S. PATENT DOCUMENTS

| | | | |
|---|---|---|---|
| 3,324,799 | 6/1967 | Terrano . | |
| 3,881,839 | 6/1975 | MacManus . | |
| 4,209,284 | 6/1980 | Lochmann et al. | 415/55.6 |
| 4,408,952 | 10/1983 | Schweinfurter . | |
| 4,556,363 | 12/1985 | Watanabe et al. . | |
| 4,672,937 | 6/1987 | Fales et al. . | |
| 4,776,315 | 10/1988 | Greiner . | |
| 5,058,557 | 10/1991 | Frank et al. | 123/497 |
| 5,111,844 | 5/1992 | Emmert et al. . | |
| 5,129,796 | 7/1992 | Emmert et al. . | |
| 5,149,252 | 9/1992 | Tuckey et al. . | |
| 5,336,045 | 8/1994 | Koyama et al. | 415/55.1 |
| 5,338,151 | 8/1994 | Kemmner et al. . | |
| 5,401,143 | 3/1995 | Yu . | |
| 5,413,457 | 5/1995 | Tuckey . | |
| 5,435,691 | 7/1995 | Braun et al. | 415/55.6 |
| 5,472,321 | 12/1995 | Radermacher . | |

FOREIGN PATENT DOCUMENTS

| | | |
|---|---|---|
| 2112762 | 10/1972 | Germany . |
| 2460518 | 7/1975 | Germany . |
| 3118533 | 12/1982 | Germany . |
| 3427112 | 7/1984 | Germany . |
| 58-119990 | 7/1983 | Japan . |
| 58-119991 | 7/1983 | Japan . |
| 61-190191 | 8/1986 | Japan . |
| 480225 | 11/1975 | U.S.S.R. . |
| 2134598 | 2/1983 | United Kingdom . |

*Primary Examiner*—Thomas N. Moulis
*Attorney, Agent, or Firm*—Neil P. Ferraro

[57] ABSTRACT

A single fuel pump for a fuel delivery system supplies fuel from the fuel tank to a reservoir and also supplies fuel from the reservoir to the engine. The fuel pump has a single impeller having outer vanes and inner vanes radially inward from the outer vanes. The vanes are aligned with outer and inner channels in the pump housing, respectively, so that fuel may be pumped from the fuel tank into the reservoir. Fuel from the reservoir is then pumped to the engine.

19 Claims, 2 Drawing Sheets

FUEL PUMP FOR AN AUTOMOTIVE FUEL DELIVERY SYSTEM

FIELD OF THE INVENTION

The present invention relates to an automotive fuel delivery system, and more particularly to a fuel pump for a fuel delivery system.

BACKGROUND OF THE INVENTION

Automotive fuel delivery systems typically include a reservoir in the fuel tank and a fuel pump submerged in the reservoir to supply fuel to the engine. The purpose of the reservoir is to keep the pump inlet submerged under operating conditions which could otherwise expose the inlet, such as when the vehicle is parked on an incline with an almost empty fuel tank or during cornering maneuvers wherein fuel moves away from the fuel inlet. To keep the reservoir full, some systems use a jet pump, powered by either a portion of the high pressure output of the fuel pump or return fuel from the engine, to aspirate fuel from the tank into the reservoir. Other fuel delivery systems utilize a second pumping element dedicated to filling the reservoir. The inventors of the present invention have recognized certain disadvantages in these systems. Generally, these systems require a large number of parts resulting in high cost and complexity.

SUMMARY OF THE INVENTION

An object of the present invention is to provide a single pump for pumping fuel from the tank into the reservoir and for pumping fuel from the reservoir to the engine. This object is achieved and disadvantages of prior art approaches overcome, by providing a novel fuel delivery system for an automotive internal combustion engine. The system includes a fuel tank, a reservoir positioned in the tank in fluid communication therewith, and a fuel pump for pumping fuel from the fuel tank to the reservoir and for pumping fuel from the reservoir to the engine. The fuel pump includes a pump casing, a motor housed within the casing and having a drive shaft extending therefrom, and an impeller engaged with the drive shaft. The impeller has first and second sets of vanes to pump the fuel. An impeller housing is mounted within the pump casing and encases the impeller therein. The impeller housing includes a first channel having a fuel tank inlet and a reservoir outlet and being in fluid communication exclusively therebetween. The first channel is radially aligned with the first set of vanes such that when the impeller rotates, fuel from the fuel tank enters the fuel tank inlet, flows through the first channel and exits through the reservoir outlet to fill the reservoir with fuel. The impeller housing also includes a second channel having a reservoir inlet and a fuel outlet and being in fluid communication exclusively therebetween. The second channel is radially aligned with the second set of vanes such that when the impeller rotates, fuel from the reservoir enters the reservoir inlet, flows through the second channel and exits through the fuel outlet to supply fuel to the engine.

An advantage of the present invention is that fuel to the fuel pump is continuously supplied by submerging the fuel pump in a reservoir in the fuel tank.

Another advantage of the present invention is that a single pump is used to fill both the reservoir as well as to supply fuel to the engine.

Still another advantage of the present invention is that a single impeller is used in the fuel pump to reduce the current draw of the fuel pump by balancing the load imposed upon the impeller by high and low pressure regions, thereby reducing impeller drag.

Yet another advantage of the present invention is that the complexity of the fuel delivery system is reduced.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
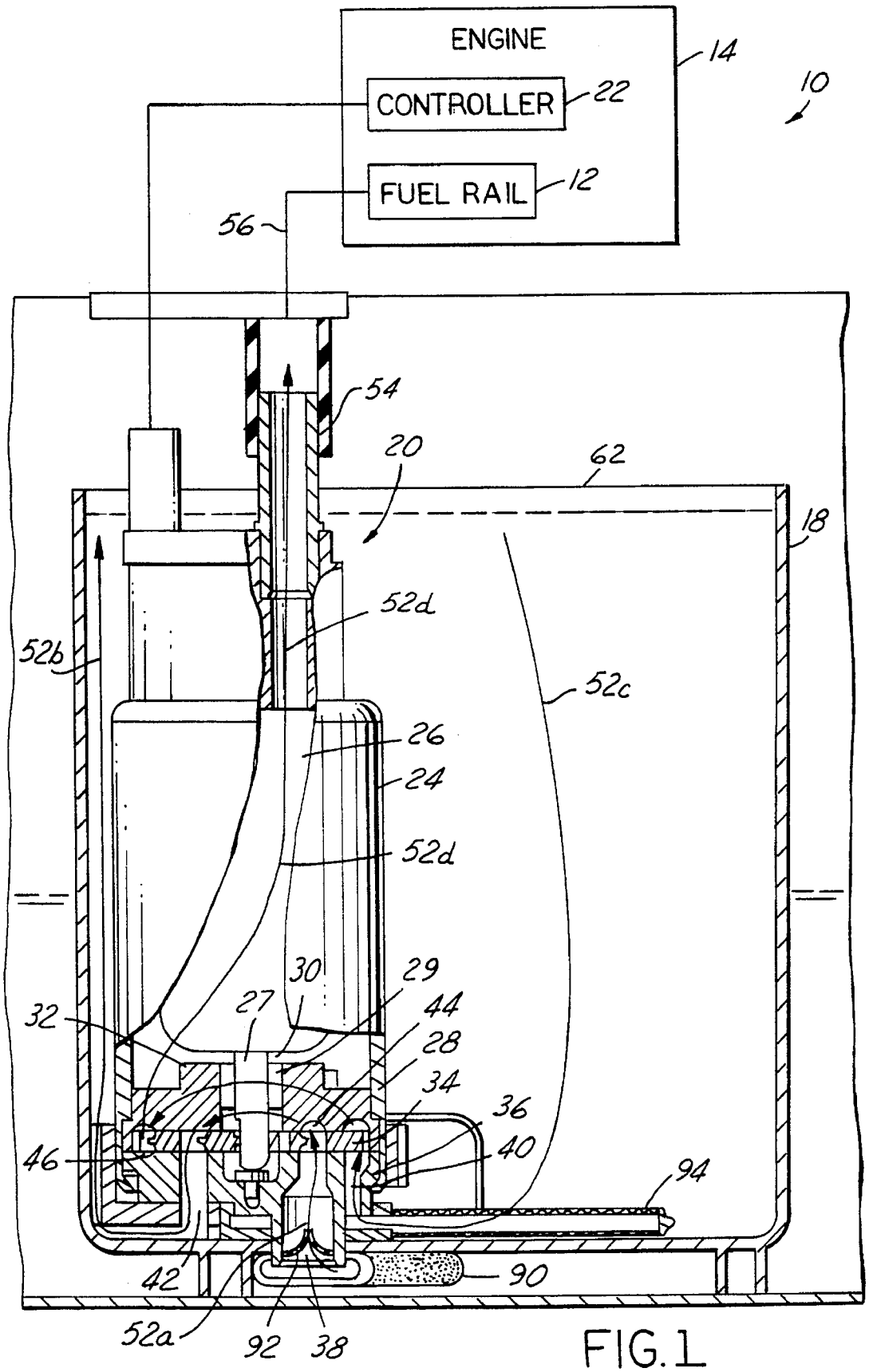
FIG. 1 is a diagrammatic view of a fuel delivery system for an internal combustion engine according to the present invention.

Fuel delivery system 10, shown in FIG. 1, supplies fuel to fuel rail 12 of internal combustion engine 14. Fuel delivery system 10 includes fuel tank 16, reservoir 18 within fuel tank 16 and fuel pump 20 submerged within reservoir 18. Fuel pump 20 is an electric fuel pump controlled by controller 22 of engine 14. Fuel pump 20 includes fuel pump casing 24, shown partially broken, and motor 26 mounted within casing 24. Motor 26 has shaft 27 extending therefrom, which passes through impeller housing 28, through opening 30 of pump bottom 32 to engage impeller 34. Impeller 34 is keyed to shaft 27 such that when shaft 27 rotates, impeller 34 rotates. As is well known to those skilled in the art, shaft 27 may pass through bearing 29 in pump bottom 32.

Figure 2:
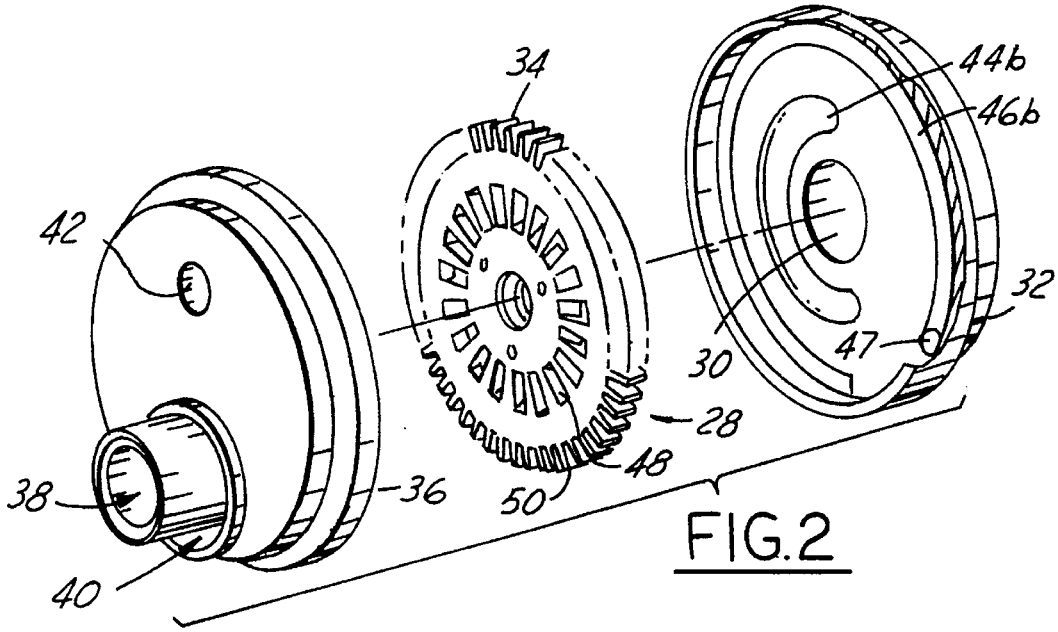
FIG. 2 is a diagrammatic perspective exploded view of a fuel pump housing and impeller according to the present invention.
Figure 3:
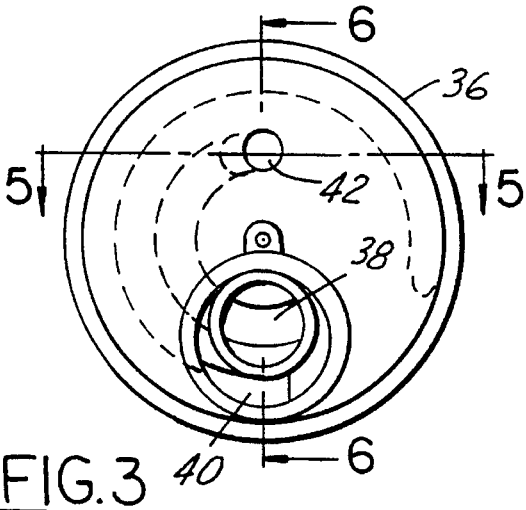
FIG. 3 is a front elevation of a cover of the housing.
Figure 4:
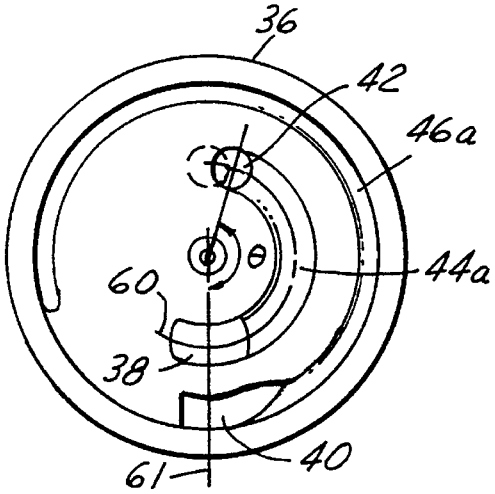
FIG. 4 is a rear elevation of the housing cover.

As best shown in FIGS. 2–4, impeller housing 28 includes pump bottom 32 and pump cover 36. Cover 36 includes fuel tank inlet 38, reservoir inlet 40, and reservoir outlet 42. Cover 36 also includes a first inner channel 44*a* and second outer channel 46*a* (see FIG. 4). Pump bottom 32 includes first inner channel 44*b* and second outer channel 46*b* (see FIG. 2). Thus when pump housing 28 is assembled, inner channels 44*a* and 44*b* cooperate to form channel 44 and outer channels 46*a* and 46*b* cooperate to form channel 46 (see also FIG. 1).

Impeller 34, shown in FIG. 2, includes first set of inner vanes 48 and a second set of outer vanes 50 located on the circumference of impeller 34. Vanes 48 are located radially inward of and coplanar with vanes 50. When pump housing 28 is assembled with impeller 34 encased therein, inner vanes 48 are radially aligned with channel 44 and outer vanes 50 are radially aligned with channel 46. As shown in the example described herein, vanes 48 and 50 are straight. However, those skilled in the art will recognize in view of this disclosure that either vanes 48 or 50 or both may be at least partially curved. Indeed, the direction of curvature with respect to the rotational direction of impeller 36 may be selected by those skilled in the art in view of this disclosure. In addition, the spacing between the vanes of outer and inner vanes 48, 50 may be optimized to reduce vapor generation and set the fuel flow rate as will be described hereinafter.

Thus, according to the present invention, as shown by arrows 52*a*–52*d* in FIG. 1, fuel 52*a* from fuel tank 16 enters fuel tank inlet 38 and is pumped by inner vanes 48 of impeller 34 through channel 44. Fuel, shown as 52*b*, exits through reservoir outlet 42 to fill reservoir 18. Fuel 52*c* within reservoir 18 then enters reservoir inlet 40 and is pumped by outer vanes 50 of impeller 34 through channel 46. Fuel 52*d* is then pumped out fuel outlet 47 (FIG. 2) through pump bottom 32 to supply fuel to engine 14. Because channel 44 does not communicate with channel 46, fuel entering fuel tank inlet 38 is not directly pumped out through fuel outlet 47. In addition, the two channels 44, 46 balance the impeller 34 between high and low pressure regions, thereby reducing drag caused by impeller 34 contacting cover 36 or bottom 32. As is well known to those skilled in the fuel pump art, fuel 52*d* leaving fuel outlet 47 passes over motor 26 to cool the motor and flows through fuel pump outlet 54 to connect with fuel line 56.

Referring in particular to FIG. 4, inner channel 44*a* in cover 36 extends along arc 60 through angle θ. In the example shown herein, angle θ is less than 180°. This has the effect of reducing both vapor generation and drag. In addition, as shown in FIG. 4, fuel tank inlet 38 and reservoir inlet 40 are radially arrayed along line 61 radially extending from the center of cover 36. Those skilled in the fuel pump art will recognize that, as fuel is pumped through channels 44 and 46, the fuel pressure increases. If inlets 38 and 40 were not radially arrayed along line 61, there might exist a pressure difference between channels 44 and 46, which could result in undesirable leaking therebetween. Radially positioning inlets 38 and 40 along line 61 reduces any such leaking.

Figure 6:
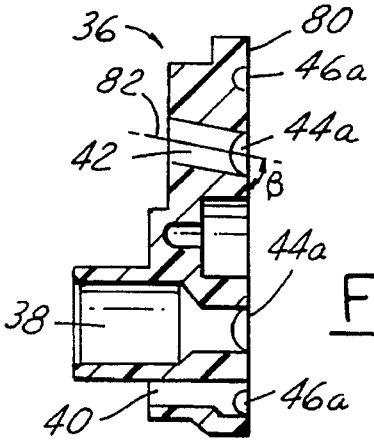
FIG. 6 is a cross-sectional view taken along line 6—6 of FIG. 3.
Figure 5:
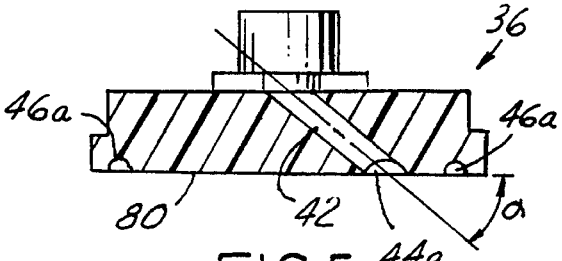
FIG. 5 is a cross-sectional view taken along line 5—5 of FIG. 3.

Turning now to FIGS. 5 and 6, which represent cross-sectional views of pump cover 36, reservoir outlet 42 of pump cover 36 is inclined relative to the plane of impeller facing surface 80 in two directions. In FIG. 5, reservoir outlet 42 is inclined such that the included angle α between surface 80 and axis 82 of inlet 42 is less than 90°. Similarly, in FIG. 6, the included angle β between surface 80 and axis 82 is less than 90°. The angle of inclination of outlet 42 is such that the orientation of outlet 42 substantially follows the annular curve of inner channel 44. This also reduces vapor generation of the fuel and also allows for more efficient pump operation.

According to the present invention, it is desirable to pump more fuel through inner channel 44 than through outer channel 46 because it is desirable to keep reservoir 18 full. In fact, in this example, excess fuel from reservoir 18 spills over top 62 of reservoir 18 and into fuel tank 16 (FIG. 2). Those skilled in the art will recognize, in view of this disclosure, various alternatives to achieve this result. One particular alternative is to provide a greater volume of space within inner channel 44. As shown in FIGS. 5 and 6, this is accomplished by inner channel 44*a* being deeper than outer channel 46*a* relative to surface 80. Similarly, inner channel 44*b* of pump bottom 32 may be deeper that outer channel 46*b*. Of course, inner channel 44 may be wider than outer channel 46. In addition, those skilled in the art will recognize in view of this disclosure that inner vanes 48 of impeller 34 may be designed to cooperate with inner channel 44 to provide an increased fuel flow rate therethrough.

In a preferred embodiment, fuel delivery system 10 includes a fuel tank inlet filter 90 and fuel inlet check valve 92, such as a flapper valve. In addition, reservoir inlet may have filter 94. The purpose of check valve 92 is to prevent fuel in reservoir 18 from leaking back through fuel pump 20 to fuel tank 16. As would be apparent to one of ordinary skill in the art, because the fuel level in reservoir 18 is higher than the fuel level in fuel tank 16 (see FIG. 1), there is a positive pressure head which would otherwise cause fuel to drain if check valve 92 was not provided.

While the best mode for carrying out the invention has been described in detail, those skilled in the art in which this invention relates will recognize various alternative designs and embodiments, including those mentioned above, in practicing the invention that has been defined by the following claims.

We claim:

1. A fuel delivery system for an automotive internal combustion engine comprising:

a fuel tank;

a reservoir mounted inside and in fluid communication with said tank;

a fuel pump for pumping fuel from said fuel tank to said reservoir and for pumping fuel from said reservoir to said engine, said fuel pump comprising:

a pump casing;

a motor housed within said casing and having a drive shaft extending therefrom;

an impeller engaged onto said drive shaft and having first and second sets of vanes; and, an impeller housing mounted within said pump casing and encasing said impeller therein, said impeller housing comprising:

i) a first channel having a fuel tank inlet and a reservoir outlet and being in fluid communication exclusively therebetween, said first channel being radially aligned with said first set of vanes such that when said impeller rotates, fuel from said fuel tank enters said fuel tank inlet, flows through said first channel and exits through said reservoir outlet to fill said reservoir with fuel; and, ii) a second channel having a reservoir inlet and a fuel outlet and being in fluid communication exclusively therebetween, said second channel being radially aligned with said second set of vanes such that when said impeller rotates, fuel from said reservoir enters said reservoir inlet, flows through said second channel and exits through said fuel outlet to supply fuel to said engine.

2. A system according to claim 1 wherein said impeller housing comprises:

a cover comprising said fuel tank inlet, said reservoir inlet, and said reservoir outlet, a first annular cover channel in fluid communication between said fuel tank inlet and said reservoir outlet, and a second annular cover channel in fluid communication with said reservoir inlet; and, a fuel pump bottom comprising a fuel outlet, a first annular bottom channel cooperating with said first annular cover channel to form said first channel, and a second annular bottom channel in fluid communication with said fuel outlet, said second annular bottom channel cooperating with said second annular cover channel to form said second channel.

3. A system according to claim 2 wherein said second set of vanes is located about the circumference of said impeller and wherein said first set of vanes is located radially inward of said second set of vanes.

4. A system according to claim 1 wherein said first and said second sets of vanes are coplanar.

5. A system according to claim 1 having a first fuel flow rate through said first channel greater than a second fuel flow rate through said second channel.

6. A system according to claim 1 wherein said fuel tank inlet and said reservoir inlet are substantially radially arrayed along a radial line extending from the center of said pump housing.

7. A system according to claim 2 wherein said reservoir outlet has an axis, with said axis being inclined at an included angle relative to an impeller facing surface of said cover such that said included angle is less than 90° in at least one direction.

8. A system according to claim 1 a fuel filter is located upstream of said reservoir inlet.

9. A system according to claim 1 a fuel filter is located upstream of said fuel tank inlet.

10. A system according to claim 1 wherein a check valve is located upstream of said fuel tank inlet positioned to allow fuel flow toward said fuel tank inlet.

11. A system according to claim 1 wherein said fuel pump is mounted within said reservoir.

12. A fuel pump for a fuel delivery system of an automotive internal combustion engine, the fuel delivery system having a fuel tank, and a reservoir in said tank and in fluid communication therewith, said fuel pump supplies fuel from said fuel tank to said reservoir and supplies fuel from said reservoir to said engine, said fuel pump comprising:

a pump casing;

a motor housed within said casing and having a drive shaft extending therefrom;

an impeller engaged onto said drive shaft and having first and second sets of vanes; and, an impeller housing mounted within said pump casing and encasing said impeller therein, said impeller housing comprising:

a first channel having a fuel tank inlet and a reservoir outlet and being in fluid communication exclusively therebetween, said first channel being radially aligned with said first set of vanes such that when said impeller rotates, fuel from the fuel tank enters said fuel tank inlet, flows through said first channel and exits through said reservoir outlet to fill the reservoir with fuel; and, a second channel having a reservoir inlet and a fuel outlet and being in fluid communication exclusively therebetween, said second channel being radially aligned with said second set of vanes such that when said impeller rotates, fuel from the reservoir enters said reservoir inlet, flows through said second channel and exits through said fuel outlet to supply fuel to the engine.

13. A fuel pump according to claim 12 wherein said impeller housing comprises:

a cover comprising said fuel tank inlet, said reservoir inlet, and said reservoir outlet, a first annular cover channel in fluid communication between said fuel tank inlet and said reservoir outlet, and a second annular cover channel in fluid communication with said reservoir inlet; and, a fuel pump bottom comprising a fuel outlet, a first annular bottom channel cooperating with said first annular cover channel to form said first channel, and a second annular bottom channel in fluid communication with said fuel outlet, said second annular bottom channel cooperating with said second annular cover channel to form said second channel.

14. A fuel pump according to claim 13 wherein said second set of vanes is located about the circumference of said impeller and wherein said first set of vanes is located radially inward of said second set of vanes.

15. A fuel pump according to claim 12 having a first fuel flow rate through said first channel greater than a second fuel flow rate through said second channel when in use.

16. A fuel pump according to claim 12 wherein said fuel tank inlet and said reservoir inlet are substantially radially arrayed along a radial line extending from the center of said pump housing.

17. A fuel pump according to claim 13 wherein said reservoir outlet has an axis, with said axis being inclined at an included angle relative to an impeller facing surface of said cover such that said included angle is less than 90° in at least one direction.

18. A fuel pump in a fuel delivery system of an automotive internal combustion engine, the fuel delivery system having a fuel tank, and a reservoir mounted inside and in fluid communication with the tank, with said fuel pump comprising:

a first fuel pumping area comprising a pump housing having a first channel and an impeller rotatably mounted in said fuel pump, said impeller having a first set of vanes radially aligned with said first channel such that, as said impeller rotates, fuel is pumped from the tank through said first channel to fill the reservoir; and, a second fuel pumping area comprising a second channel in said pump housing and a second set of vanes on said impeller, said second set of vanes being coplanar with said first set of vanes and radially aligned with said second channel such that, as said impeller rotates, fuel is pumped from the reservoir through said second channel to supply fuel to the engine.

19. A fuel pump according to claim 18 having a first fuel flow rate through said first channel greater than a second fuel flow rate through said second channel when in use.

* * * * *